US008483362B2

(12) United States Patent
Freund

(10) Patent No.: US 8,483,362 B2
(45) Date of Patent: Jul. 9, 2013

(54) COLLIMATOR MODULE FOR THE MODULAR ASSEMBLY OF A COLLIMATOR FOR A RADIATION DETECTOR AND RADIATION DETECTOR

(75) Inventor: Andreas Freund, Heroldsbach (DE)

(73) Assignee: Siemens Aktiengesellschaft, Munich (DE)

( * ) Notice: Subject to any disclaimer, the term of this patent is extended or adjusted under 35 U.S.C. 154(b) by 280 days.

(21) Appl. No.: 12/957,439

(22) Filed: Dec. 1, 2010

(65) Prior Publication Data

US 2011/0129069 A1 Jun. 2, 2011

(30) Foreign Application Priority Data

Dec. 2, 2009 (DE) ..... 10 2009 056 722

(51) Int. Cl.
*G21K 1/02* (2006.01)

(52) U.S. Cl.
USPC ..... 378/147; 378/19

(58) Field of Classification Search
USPC ..... 378/147–153, 19, 98.8; 250/370.08, 250/370.09, 370.11
See application file for complete search history.

(56) References Cited

U.S. PATENT DOCUMENTS 6,587,538 B2 * 7/2003 Igarashi et al. ..... 378/19
6,982,423 B2 1/2006 Elgali
2004/0065839 A1 4/2004 Elgali

FOREIGN PATENT DOCUMENTS

JP 2003177181 A 6/2003

* cited by examiner

*Primary Examiner* — Courtney Thomas
(74) *Attorney, Agent, or Firm* — Harness, Dickey & Pierce

(57) ABSTRACT

A collimator module is disclosed for the modular assembly of a collimator for a radiation detector with a multiplicity of absorber elements, which are arranged one behind the other in a collimation direction and held by a carrier. In at least one embodiment, the carrier has at least one alignment device for aligning the collimator module in the collimation direction, which alignment device(s) interact with positioning device(s) in a detector mechanism of the radiation detector when they are integrated into the radiation detector. This provides the preconditions for integrating the collimator module in a fashion that is decoupled from a radiation convertor, and so this allows easy assembly of a collimator and adjustment to a position assumed between a radiation convertor and the collimator. Moreover, a radiation detector with such a collimator module is disclosed.

18 Claims, 6 Drawing Sheets

COLLIMATOR MODULE FOR THE MODULAR ASSEMBLY OF A COLLIMATOR FOR A RADIATION DETECTOR AND RADIATION DETECTOR

PRIORITY STATEMENT

The present application hereby claims priority under 35 U.S.C. §119 on German patent application number DE 10 2009 056 722.4 filed Dec. 2, 2009, the entire contents of which are hereby incorporated herein by reference.

FIELD

At least one embodiment of the invention generally relates to a collimator module for the modular assembly of a collimator for a radiation detector and/or a radiation detector.

BACKGROUND

Scattered radiation is substantially generated by the interaction between primary radiation, emanating from the focus of a radiation source, and the object to be examined. Scattered radiation impinging on a radiation convertor of a radiation detector from a different spatial direction than the primary radiation as a result of this interaction causes image artifacts in the reconstructed image.

Thus, collimators are placed upstream of the radiation convertors in order to reduce the detected proportion of scattered radiation in the detector signals. By way of example, known collimators comprise absorber elements, which are arranged next to one another in a collimation direction and are aligned in a unidirectional fashion in respect of their longitudinal extent. In the radial direction, the absorber surfaces of the absorber elements are aligned in a fan-shaped fashion with respect to the focus of a radiation source, and so only radiation from the spatial direction in the direction of the focus can impinge on the radiation detector. By contrast, scattered radiation proportions are absorbed by the absorber surfaces of the absorber elements.

A slight tilt of the absorber elements compared to an intended alignment, or erroneous positioning of the absorber elements, or the entire collimator, compared to the radiation convertor, already leads to shadowing of the active regions of the radiation convertor and hence to falsification of or reduction in an attainable signal-to-noise ratio. Hence, a particular challenge when assembling a radiation detector is, firstly, to manufacture the collimator in a very precise shape and, secondly, to align the collimator very precisely with respect to the radiation convertor. Here, positional accuracy of the order of a few 10 μm must be attainable and also verifiable by metrological means.

The integration of the collimator into the radiation detector is complicated by the fact that the active regions of the detector elements in the radiation convertor are, for the most part, no longer visible from the outside when aligning the collimator. In indirect-conversion radiation convertors, in which the radiation is converted indirectly into electrical signals via the generation of light pulses by an incident X-ray quantum, the scintillator array used to generate the light pulses is covered by an opaque cover-reflector on the side of the beam incidence direction. Hence the structuring of the scintillator array is no longer visible from the outside during the integration of the collimator.

JP 2003 177 181 AA and U.S. Pat. No. 6,982,423 B2 have disclosed radiation detectors, in which the collimator is produced in small units and, in the form of tiles or a matrix, is screwed to a radiation detector or radiation detector module. Moreover, embodiments are known in which the collimator modules are directly adhesively bonded onto the radiation convertor. Alternatively, the collimator modules in this case are aligned with respect to the outer edges of the radiation convertor. However, in the known cases, possible faulty positioning or tilting of the absorber elements of the collimator can only be detected in a subsequent test when the radiation detector has been completely assembled. Replacing a collimator module in such a collimator is very costly and requires much time.

SUMMARY

In at least one embodiment of the invention, a collimator module and/or a radiation detector are embodied such that the preconditions for a simpler assembly and simpler maintenance of the radiation detector are met.

In at least one embodiment, this is achieved by a collimator module and/or by a radiation detector. Advantageous embodiments and developments are the subject matter of dependent claims.

The collimator module according to at least one embodiment of the invention for the modular assembly of a collimator for a radiation detector comprises a multiplicity of absorber elements, which are arranged one behind the other in a collimation direction and held by a carrier, wherein the carrier has alignment device(s) for aligning the collimator module in the collimation direction, which alignment device (s) interact with positioning device(s) in a detector mechanism of the radiation detector when they are integrated into the radiation detector.

Thus, the alignment device(s) are used for the precise alignment of the collimator module relative to the detector mechanism of the radiation detector. Hence, in this approach, the integration of the collimator module into the radiation detector is decoupled from an integration of a radiation convertor. This decoupling in particular allows a precise alignment or a precise readjustment of these components relative to one another with little effort, even after their integration into the radiation detector. By way of example, the assembly of a radiation detector may be implemented as follows: individual radiation convertor modules for assembling the radiation convertor on the one hand and, decoupled therefrom, the individual collimator modules on the other hand are inserted into the detector mechanism in separate process steps. The collimator modules are positioned on the base of the alignment device(s) provided in the carrier, which alignment device(s) interact with corresponding positioning device(s) in the detector mechanism. Corresponding alignment device(s) and positioning device(s) may be provided for integrating the radiation convertor modules. If necessary, the radiation convertor modules may be readjusted or aligned in a precise fashion relative to the collimator modules in a subsequent process step.

Thus the preconditions for a simpler assembly and simpler maintenance of the radiation detector are created by the alignment device(s) provided in the carrier, which alignment device(s) interact with corresponding positioning device(s) in the detector mechanism.

The alignment device(s) in the carrier are preferably recesses. Such alignment device(s), for example U-shaped recesses, can be produced very precisely in a simple fashion.

The carrier preferably also has support device(s) for positioning the collimator module in a beam incidence direction, which support device(s) interact with abutment device(s) in the detector mechanism of the radiation detector when they are integrated into the radiation detector. During the insertion of the collimator module, the weight of the collimator module is supported from a direction in which gravity acts as well and hence not by the alignment device(s), and so the accuracy of the alignment is not reduced by an additional mechanical load on the alignment device(s). In the simplest case the support device(s) are edges of the carrier that abut against an abutment surface of the detector mechanism during integration. Such support device(s) can be produced in a particularly simple and precise fashion.

In an advantageous embodiment of the invention, the carrier is formed from two carrier elements extending in the collimation direction, wherein the absorber elements are connected to the carrier elements in a cross-shaped fashion. Hence, the carrier elements as supporting parts form two sidewalls in which the absorber elements are held. Hence the carrier has very little complexity and can be produced with little effort. The cross-shaped connections between the absorber elements and the carrier elements ensure the necessary stability of the collimator. The carrier elements are ideally designed to be completely identical.

The two carrier elements and/or the absorber elements preferably have a plate-like design. As a result of the possibility of stacking the elements connected with this, all carrier elements required for assembling the collimator can be produced in a single work step by simultaneous electric discharge wire cutting. The same holds true for the production of the absorber elements, in which up to 300 absorber elements can be produced in a single work step by simultaneous electric discharge wire cutting.

The cross-shaped connections between the absorber elements and the carrier elements are preferably plug-in connections. Plug-in connections can be produced with little effort and at the same time offer a secure hold for the absorber elements in the respective carrier element. They can be formed in a particularly simple fashion by recesses or slits in the absorber elements and/or in the carrier elements. The position, the extent and the alignment of the recesses or the slits can moreover be prescribed very precisely in the region of a few μm by way of electric discharge wire cutting. The plugged-together elements can be aligned very precisely with respect to one another as a result thereof. In this case the plug-in connection satisfies a dual function. It is used both for mechanically fixing the elements amongst themselves and for aligning the elements with respect to one another. By way of example, the alignment is brought about in this case by guiding the one element in a guide channel formed by the slit.

In this context, the use of electric discharge wire cutting has the additional advantage that the recesses or slits on the carrier-element side for holding the absorber elements and the alignment device(s) can be introduced without renewed insertion of the carrier elements. Possible erroneous positioning resulting from the renewed insertion are avoided as a result of this. Hence a collimator module can be produced, in which the alignment and position of the absorber elements in respect of the alignment device(s) have a tolerance of the order of the machine inaccuracy, that is to say a few μm.

In an advantageous embodiment of the invention, the slits in the absorber elements interlock with the corresponding slits in the carrier elements in a cross-shaped fashion during the assembly of the plug-in connection. The elements are mutually guided by the two slits and thereby assume a predefined position with respect to one another.

In a further advantageous embodiment, the absorber elements are additionally adhesively bonded to the carrier elements at the cross-shaped connection points. This additionally secures the plug-in connection and increases the strength of the collimator module.

In order to increase the overall stability of the collimator, the collimator module according to one embodiment of the invention has at least one cover element in a beam incidence direction and/or a beam emergence direction, in which cover element the longitudinal edges of the absorber elements are guided at least in part. Guiding the longitudinal edges of the absorber elements to the cover element ensures that the absorber elements remain stably in position and alignment, even in the case of a large Z-coverage and high rotational speeds. This is because the transverse forces, which occur at the outer regions of the absorber elements, particularly when the recording system rotates, and are respectively directed in the opposite direction, are compensated by the affixed cover element. Moreover, the cover element protects the absorber elements from mechanical influences and hence from damages or dirt.

The carrier elements preferably have a fixing device, by which the collimator module can be fixed to the detector mechanism. By way of example, such a fixing device(s) can be a bore for holding a fixing screw or a fixing element. This ensures that the position of the collimator module with respect to the detector mechanism, which position was imparted by the alignment device(s), is maintained. However, it would also be feasible for the alignment device(s) of the carrier additionally to satisfy the function of a fixing device as well.

The radiation detector according to a second aspect of at least one embodiment of the invention has a detector mechanism for holding a collimator and a radiation convertor aligned with respect thereto, wherein the collimator is assembled from the above-described collimator modules, and wherein the alignment device(s) of the collimator modules engage in corresponding positioning device(s) in the detector mechanism for precisely positioning the collimator modules relative to the detector mechanism.

In an advantageous embodiment of the radiation detector according to the invention, the radiation convertor is subdivided into radiation convertor modules, wherein the respective collimator module in each case covers two, three, four or five radiation convertor modules. As a result of such a segmentation of the collimator with respect to the radiation convertor, the collimator can be assembled quickly with a negligible error in the positioning accuracy.

The collimator module can be produced as per the following steps:

a) simultaneously producing the carrier elements by electric discharge wire cutting, in particular for all collimator modules required for the collimator,
b) simultaneously producing the absorber elements by electric discharge wire cutting, in particular for at least one of the collimator modules,
c) aligning the carrier elements relative to one another by way of a positioning tool,
d) mounting the absorber elements in the carrier elements, wherein the absorber elements and the carrier elements have corresponding slits for producing a plug-in connection,
e) adhesively bonding the absorber elements to the carrier elements, and
f) placing and adhesively bonding cover elements on the longitudinal edges of the absorber elements in the beam incidence direction and/or beam emergence direction.

BRIEF DESCRIPTION OF THE DRAWINGS

In the following text, the invention will be explained in more detail on the basis of example embodiments and on the basis of drawings, in which.

DETAILED DESCRIPTION OF THE EXAMPLE EMBODIMENTS

Figure 1:
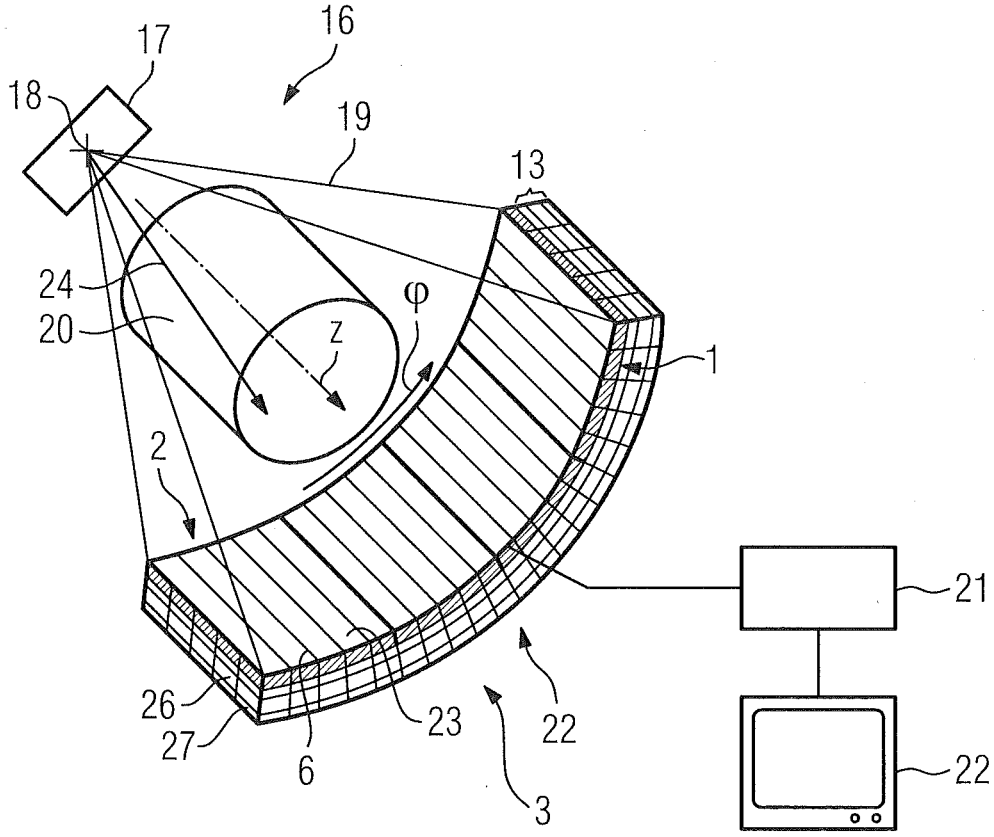
FIG. 1 shows a schematic illustration of a computed tomography scanner.

Various example embodiments will now be described more fully with reference to the accompanying drawings in which only some example embodiments are shown. Specific structural and functional details disclosed herein are merely representative for purposes of describing example embodiments. The present invention, however, may be embodied in many alternate forms and should not be construed as limited to only the example embodiments set forth herein.

Accordingly, while example embodiments of the invention are capable of various modifications and alternative forms, embodiments thereof are shown by way of example in the drawings and will herein be described in detail. It should be understood, however, that there is no intent to limit example embodiments of the present invention to the particular forms disclosed. On the contrary, example embodiments are to cover all modifications, equivalents, and alternatives falling within the scope of the invention. Like numbers refer to like elements throughout the description of the figures.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

In the figures, parts that have the same effect have been provided with the same reference signs. In the case of repeating elements in a figure, such as the absorber elements 2, only one element is provided with a reference sign in each case for reasons of clarity. The illustrations in the figures are schematic and not necessarily to scale, wherein the scale may vary between the figures.

FIG. 1 shows a computed tomography scanner 16, which comprises a radiation source 17 in the form of an X-ray tube, with an X-ray beam fan 19 emanating from the focus 18 thereof. The X-ray beam fan 19 penetrates an object 20 to be examined or a patient, and impinges on a radiation detector 3, in this case on an X-ray detector.

The X-ray tube 17 and the X-ray detector 3 are arranged opposite one another on a gantry (not illustrated here) of the computed tomography scanner 16, which gantry can be rotated in a $\phi$-direction about a system axis Z (=patient axis)

of the computed tomography scanner 16. The ϕ-direction thus represents the circumferential direction of the gantry and the Z-direction represents the longitudinal direction of the object 20 to be examined.

When the computed tomography scanner 16 is operational, the X-ray tube 17 and the X-ray detector 3, respectively arranged on the gantry, rotate about the object 20, with X-ray recordings of the object 20 being obtained from various projection directions. In each X-ray projection, X-ray radiation that has passed through the object 20 and has been attenuated thereby impinges on the X-ray detector 3. In the process, the X-ray detector 3 generates signals that correspond to the intensity of the incident X-ray radiation.

The X-ray radiation is converted into electrical signals by way of a radiation convertor 13, which is structured in the form of radiation convertor modules (not illustrated here). Each radiation convertor module has detector elements 23 that have been arranged to form an array. Each detector element 23 generates a signal by way of a photodiode 26, which is optically coupled to a scintillator 27. An evaluation unit 21 subsequently calculates one or more two-dimensional or three-dimensional images of the object 20 in a well-known fashion from the signals registered thus by the X-ray detector 3, which images can be displayed on a display unit 22.

The primary radiation emitted by the focus 18 of the X-ray tube 17 is scatted in different spatial directions in, inter alia, the object 20. This so-called secondary radiation generates signals in the detector elements 23 that cannot be distinguished from the signals of primary radiation required for the image reconstruction. Thus, without a further measure, the secondary radiation would lead to misinterpretations of the detected radiation and hence to a significant reduction in the quality of the images obtained by the computed tomography scanner 16.

In order to limit the influence of the secondary radiation, a collimator 1 is used to substantially only let the proportion of the X-ray radiation emitted by the focus 18, i.e. the proportion of the primary radiation, pass unhindered onto the radiation convertor 13, while the secondary radiation is ideally completely absorbed by the absorber surfaces of the absorber elements 6.

The collimator 1 is formed from a plurality of collimator modules 2, which are arranged one behind the other in the collimation direction ϕ, which in this case coincides with the ϕ-direction. The modular-like assembly of the collimator 1 reduces the integration complexity due to the improved manageability and reduces costs and complexity of maintaining the X-ray detector 3 because in the case of a fault it is merely a small part, namely an individual collimator module 2, and not the entire collimator 1 that needs to be replaced.

Figure 2:
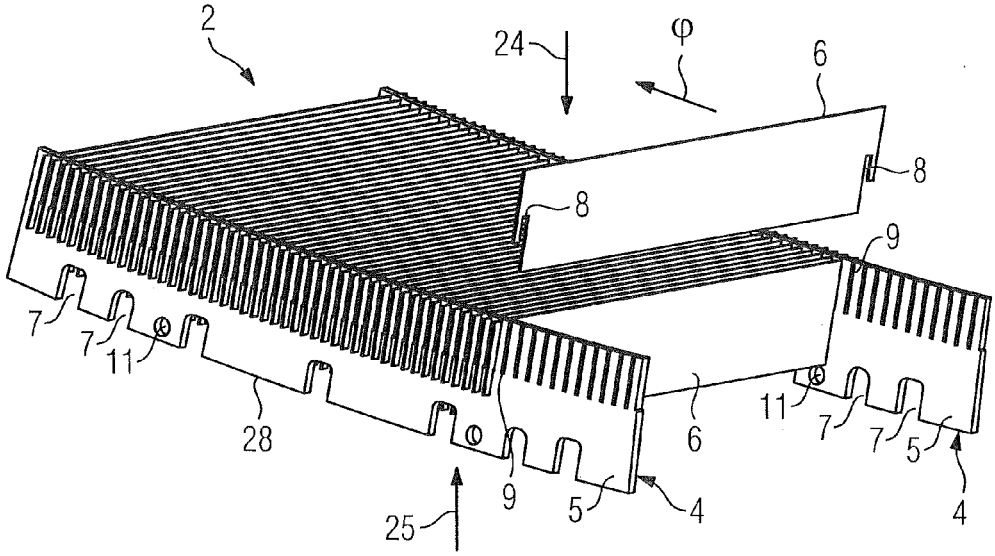
FIG. 2 shows a collimator module according to an embodiment of the invention, with two carrier elements in a state with partial fitting of absorber elements.
Figure 3:
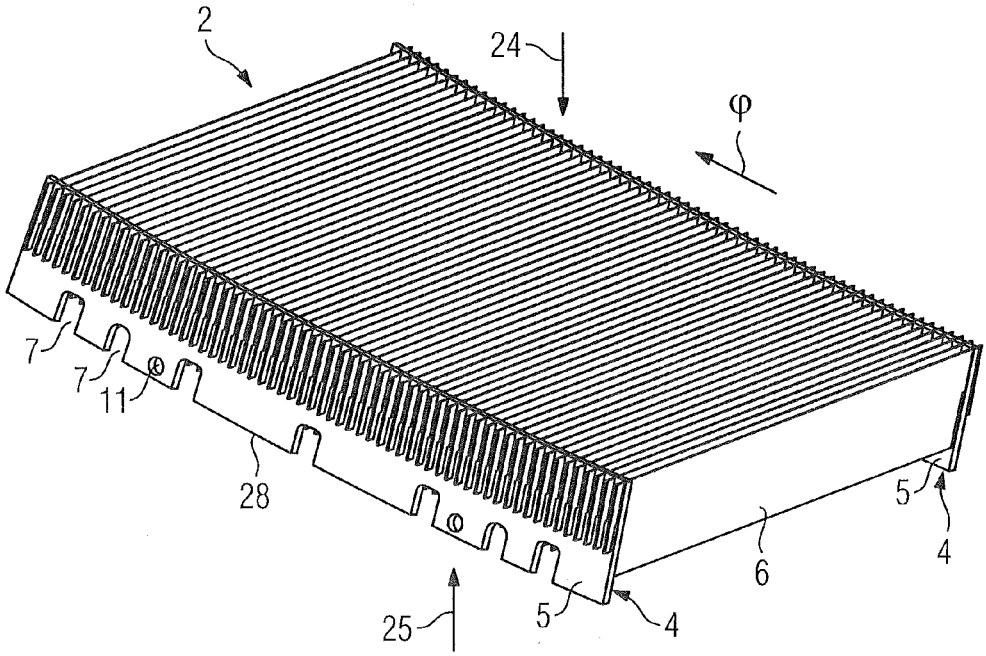
FIG. 3 shows the collimator module from FIG. 2 in a fully fitted state.

FIG. 2 shows such a collimator module 2 in a partly fitted state and FIG. 3 shows it in a state where it has been fully fitted with absorber elements 6. The collimator module 2 is fitted with a multiplicity of absorber elements 6 that are arranged one behind the other in a collimation direction ϕ and are held by a carrier 4. In this exemplary embodiment, the carrier 4 consists of two carrier elements 5 extending in the collimation direction ϕ. The carrier elements 5 are held in a positioning tool (not illustrated here) during the fitting process in order to ensure a precise alignment of the carrier elements 5 with respect to one another. The absorber elements 6 are connected to the carrier elements 5 in a cross-shaped fashion via a plug-in connection. To this end, slits 8, 9 have been introduced into the absorber elements 6 and into the carrier elements 5, with respectively one slit 9 in the carrier element 5 corresponding to respectively one of the two slits 8 in the absorber element 6. When the absorber element 6 (illustrated as hovering in FIG. 2) is inserted into the carrier elements 5, the corresponding slits 8, 9 interlock in a cross-shaped fashion. Here the slits 8, 9 have a constant breadth over their axial length and form a guide channel for the respective counterpart, in which channel the counterpart is guided. Hence the absorber elements 6 assume a defined position with respect to the carrier elements 5 when the plug-in connection has been established, and are also mechanically coupled to said carrier elements. In order to increase the mechanical stability the two elements 5, 6 are additionally adhesively bonded to one another at the corresponding connection points.

Figure 10:
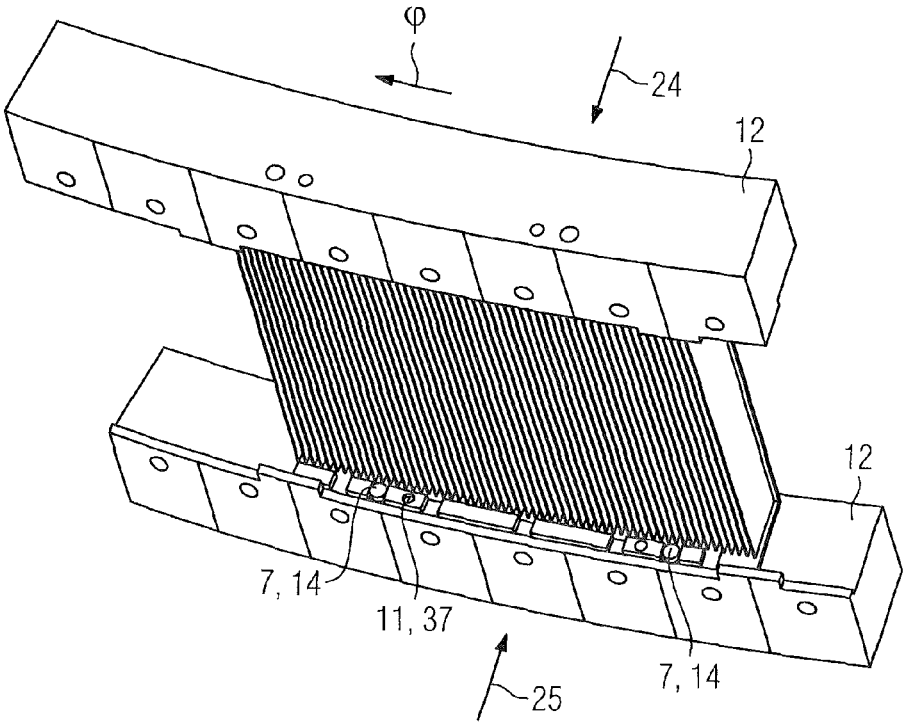
FIG. 10 shows the detector mechanism shown in FIG. 9 with a collimator module according to an embodiment of the invention.

Each of the carrier elements 5 furthermore has alignment device(s) 7 in the form of recesses, which are used to align the collimator module 2 in the collimation direction ϕ when the alignment device(s) are integrated into the X-ray detector 3. To be more precise, the alignment device(s) 7 of the carrier elements 5 engage in corresponding positioning device(s) 14 in the form of protrusions on the detector mechanism 12, as illustrated in FIG. 10. The recesses 7 in the carrier element 5 and the protrusions 14 on the detector mechanism 12 form an interlocking connection in the collimation direction ϕ. The recess 7 has a U-shaped profile in the present example. It goes without saying that it would also be feasible for the protrusions 14 to be on the carrier elements 5 and the recesses 7 to be in the detector mechanism 12.

What is decisive is that in this approach the respective collimator module 2 can be installed into the detector mechanism 12 in a way that is decoupled from a radiation convertor 13 of the X-ray detector 3. This decoupling simplifies the replacement of the collimator modules 2 and the readjustment of the relative position between the collimator modules 2 and the radiation convertor 13. Moreover, the carrier elements 5 have support device(s) 28, here in the form of the longitudinal edge of the carrier elements 5 in the beam emergence direction 25. These support device(s) 28 are used to position the collimator module 2 with respect to the detector mechanism 12 in the beam incidence direction 24. As explained below with respect to FIG. 10, the edges 28 in the installed state lie on abutment device(s) 29 in the form of projections on the detector mechanism 12. Additional fixing device(s) 11 are provided on the carrier elements 5, which fixing device(s) can fix the collimator module 2 in its position with respect to the detector mechanism 12. In the simplest case the fixing device (s) 11 are bores in the carrier elements 5.

The carrier elements 5 are embodied in a symmetric and plate-shaped fashion. Hence all carrier elements 5 required for assembling the collimator 1 can be produced very precisely in a single work step by way of electric discharge wire cutting. It is also advantageous that the slits 8 and recesses 7 in the respective carrier element 5 can be produced without renewed introduction of the workpiece, and so the tolerances between alignment device(s), fixing device(s) and holding device(s) 7, 11, 8 for the absorber elements 6 are of the order of the machine inaccuracy and hence of the order of just a few μm.

Figure 4:
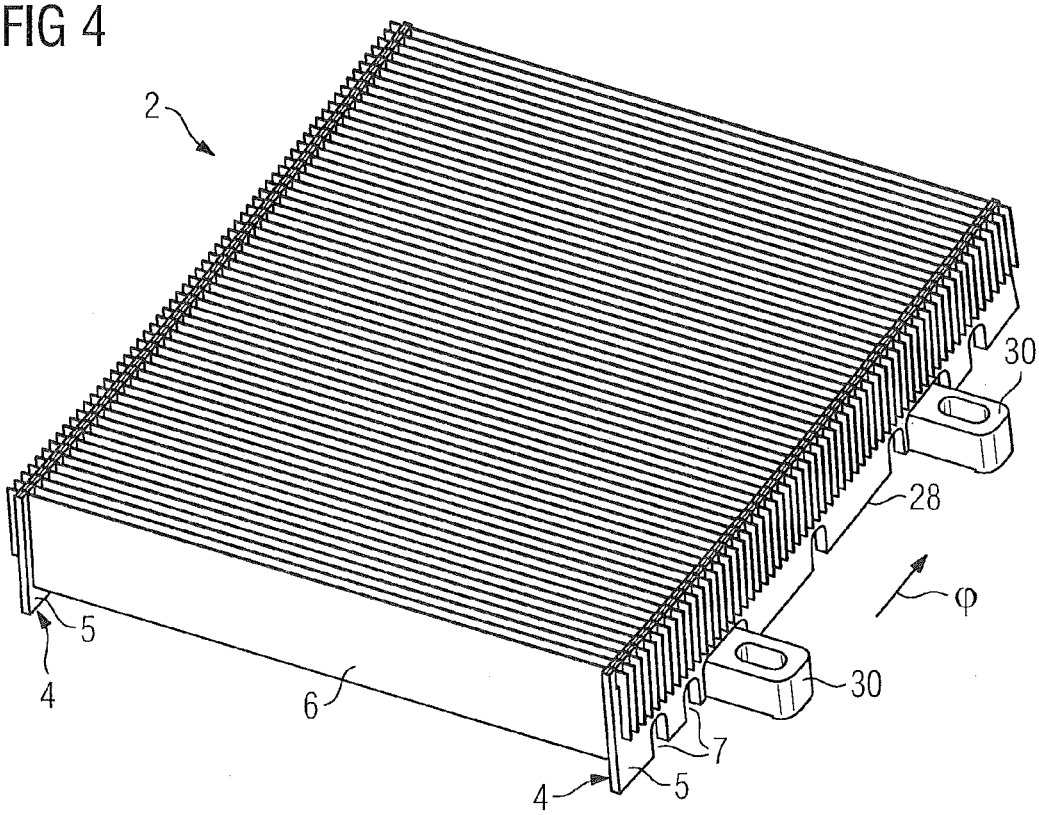
FIG. 4 shows the collimator module according to an embodiment of the invention, which has been fitted with a fixing element for fixing the collimator module to a detector mechanism of the X-ray detector.
Figure 5:
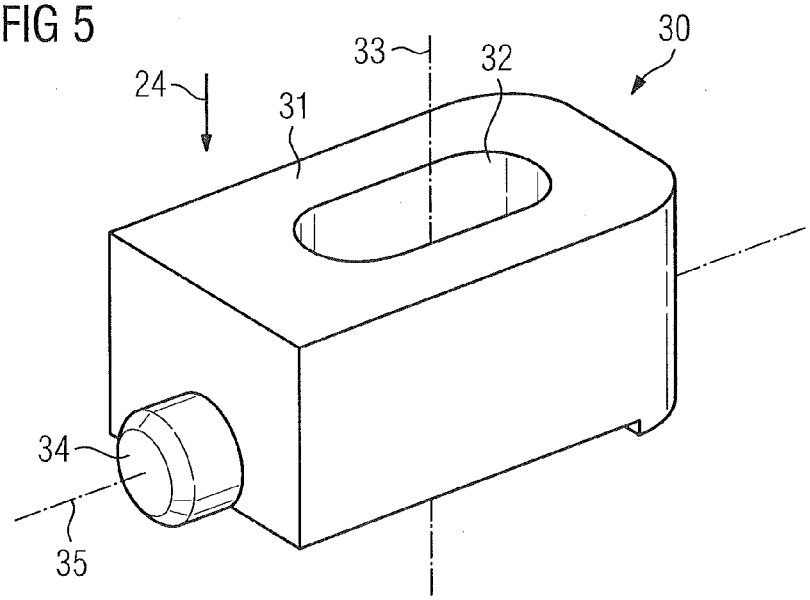
FIG. 5 shows a detailed view of the fixing element.

FIG. 4 shows the collimator module according to an embodiment of the invention, which has additionally been fitted with fixing elements 30 for fixing the collimator module 2 to the detector mechanism 12. FIG. 5 shows one of the fixing elements 30 in a detailed view. It has a basic body 31 with a bore 32 for guiding a fixing pin or a fixing screw. The bore 32 has been dimensioned across the axial direction 33 such that the fixing element 30, and hence the collimator module 2 connected thereto, can be adjusted with respect to the detector mechanism 12 within certain tolerances. A holding device 34 in the form of a pin or a stud has additionally been attached to the basic body 31. The pin 34 has been inserted into the corresponding bore-hole-shaped fixing device(s) 11 on the carrier element 5 in a tight-fitting fashion. The axial direction 35 of the pin 34 and the axial direction 33 of the bore 32 are perpendicular to one another, and so the collimator module 2 and the detector mechanism 12 can be fixed by the fixing pin or the fixing screw from the beam incidence direction 24. This direction offers the option of easier access to the X-ray detector 3 and hence simpler fixing and readjustment of the collimator module 2.

Figure 6:
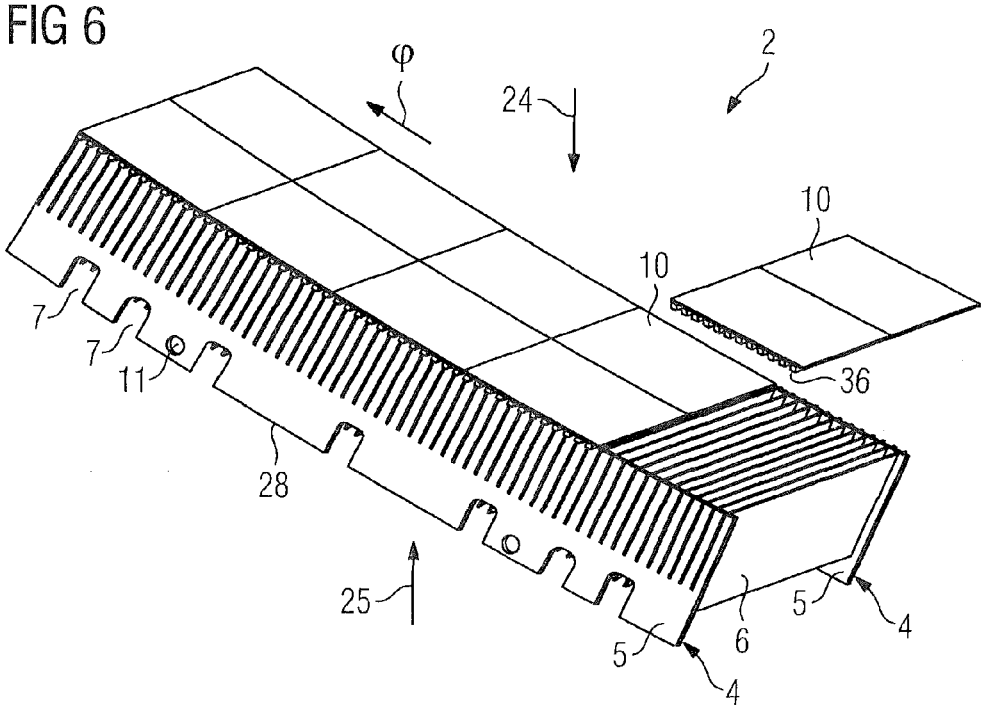
FIG. 6 shows a collimator module according to an embodiment of the invention, with cover elements in the beam incidence direction in a partially fitted state.
Figure 7:
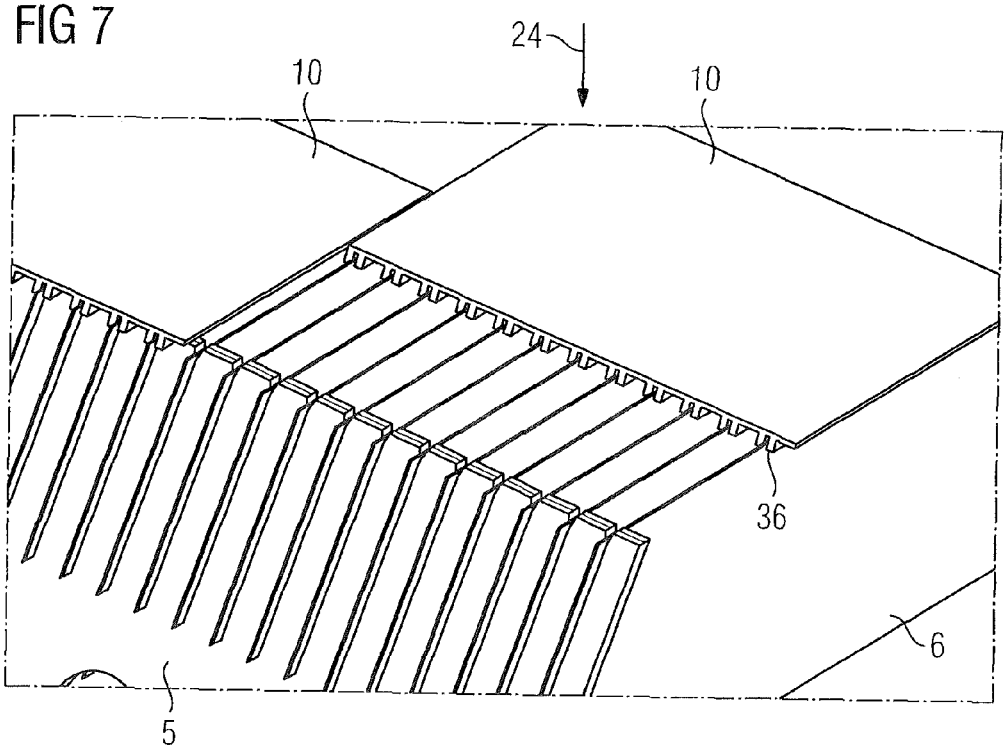
FIG. 7 shows a section of the collimator module shown in FIG. 6.
Figure 8:
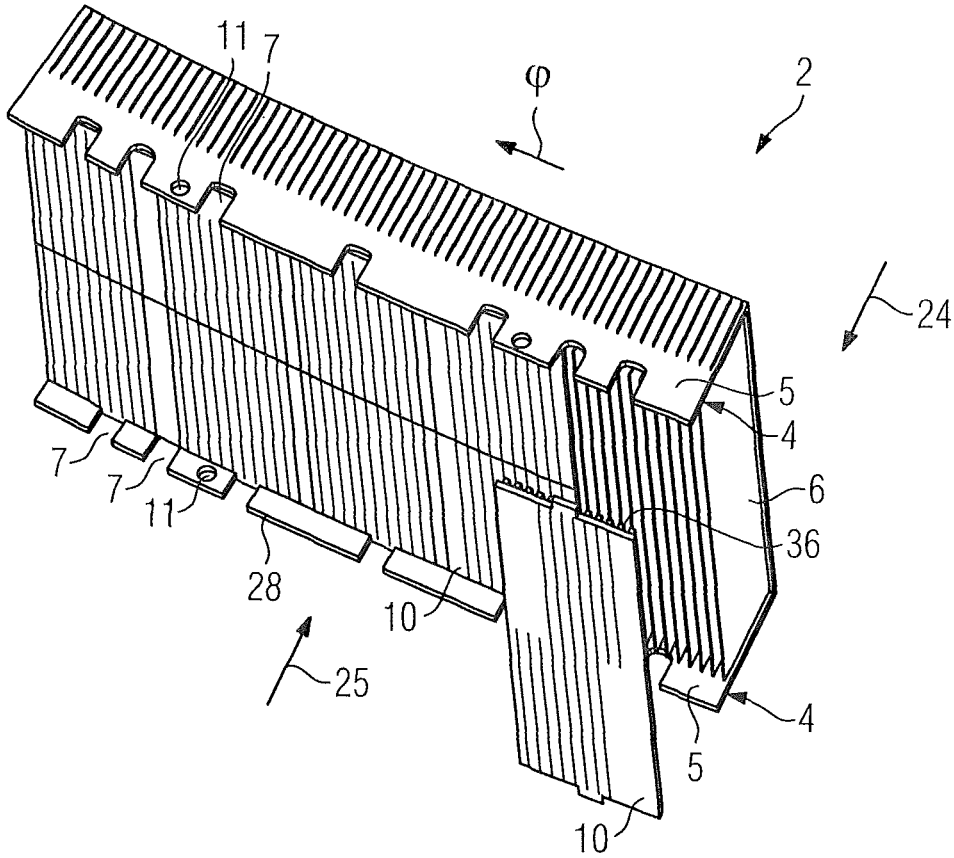
FIG. 8 shows a collimator module according to an embodiment of the invention with cover elements in the beam emergence direction in a partially fitted state.

In this example embodiment, the collimator module 2 is respectively fitted with five cover elements 10 in the beam incidence direction 24 and the beam emergence direction 25 for increasing the stability and protecting the absorber elements 6. FIG. 6 shows partial fitting of the collimator module 2 with cover elements 10 in the beam incidence direction 24. A section of the collimator module 2 can be seen in a detailed view in FIG. 7. FIG. 8 shows the collimator module 2 with partly fitted cover elements 10 from the perspective of the beam emergence direction 25.

Each cover element 10 has precisely manufactured guide grooves 36, which guide and hold the longitudinal edges of the absorber elements 6. The cover elements 10 are produced from a material that is transparent to X-ray radiation.

Figure 9:
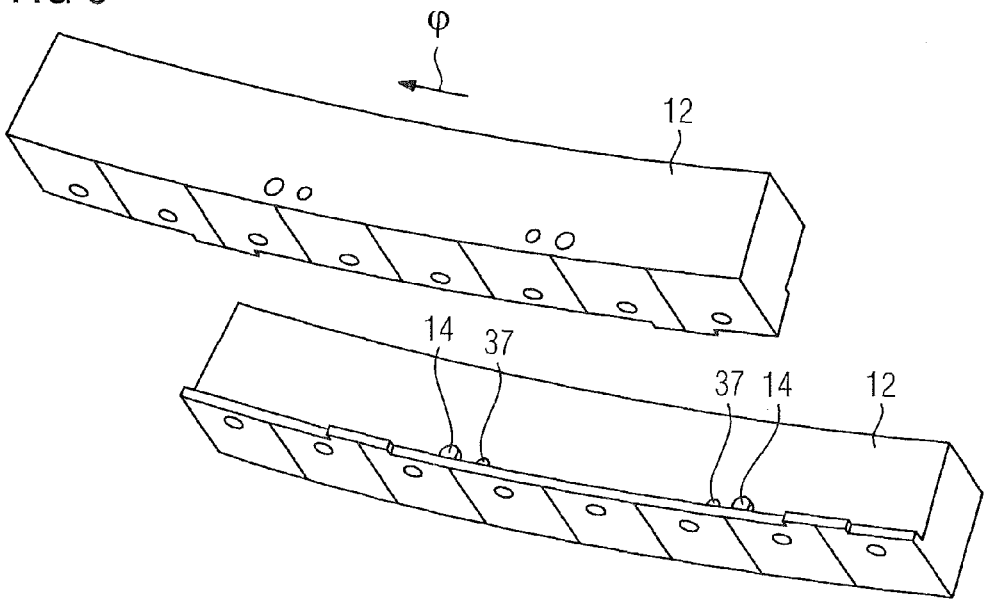
FIG. 9 shows part of a detector mechanism without an inserted collimator module.

FIG. 9 shows part of the detector mechanism 12 without a collimator module 2 and FIG. 10 shows it with an installed collimator module 2. The detector mechanism 12 has positioning device(s) 14 in the form of studs, which are used to align the collimator module 2, engage into the alignment device(s) 7 of the collimator modules 2 and hence position the latter in the collimation direction $\phi$. The collimator module 2 is carried in the detector mechanism 12 by virtue of the fact that the edges provided in the carrier elements 5 lie on corresponding projections 29 on the detector mechanism 12. The detector mechanism 12 moreover has bores that correspond to corresponding bores 11 in the carrier elements 5. These two parts are screwed together via these bores 11, 37 in order to fix them.

Reference is made to the fact that the statements should not be considered to be restricted to a collimator module 2 that is merely used to suppress the scattered radiation in the $\phi$-direction. It is immaterial to the invention whether the collimator module 2 furthermore has additional absorber elements 6 (not illustrated here), which are arranged one behind the other in the direction of the z-axis and are used for suppressing scattered radiation in the z-direction. Reference is furthermore made to the fact that beam incidence direction 24 and beam emergence direction 25 correspond to the directions of the incident and emergent radiation when the collimator module 2 is used as intended.

In conclusion, the following statement can be made:

At least one embodiment of the invention relates to a collimator module 2 for the modular assembly of a collimator 1 for a radiation detector 3 with a multiplicity of absorber elements 6, which are arranged one behind the other in a collimation direction $\phi$ and held by a carrier 4, wherein the carrier 4 has alignment device(s) 7 for aligning the collimator module 2 in the collimation direction $\phi$, which alignment device(s) interact with positioning device(s) 14 in a detector mechanism 12 of the radiation detector 3 when they are integrated into the radiation detector 3. This provides the preconditions for integrating the collimator module 2 in a fashion that is decoupled from a radiation convertor 13, and so this allows easy assembly of a collimator 1 and adjustment to a position assumed between a radiation convertor 13 and the collimator 2. At least one embodiment of the invention moreover relates to a radiation detector 3 with such a collimator module 2.

The patent claims filed with the application are formulation proposals without prejudice for obtaining more extensive patent protection. The applicant reserves the right to claim even further combinations of features previously disclosed only in the description and/or drawings.

The example embodiment or each example embodiment should not be understood as a restriction of the invention. Rather, numerous variations and modifications are possible in the context of the present disclosure, in particular those variants and combinations which can be inferred by the person skilled in the art with regard to achieving the object for example by combination or modification of individual features or elements or method steps that are described in connection with the general or specific part of the description and are contained in the claims and/or the drawings, and, by way of combineable features, lead to a new subject matter or to new method steps or sequences of method steps, including insofar as they concern production, testing and operating methods.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims. Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

Further, elements and/or features of different example embodiments may be combined with each other and/or substituted for each other within the scope of this disclosure and appended claims.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A collimator module for the modular assembly of a collimator for a radiation detector with a multiplicity of absorber elements, arranged one behind another in a collimation direction and held by a carrier, the carrier comprising:

at least one alignment device to align the collimator module in the collimation direction, the at least one alignment device interacting with at least one respective positioning device in a detector mechanism of the radiation detector when integrated into the radiation detector.

2. The collimator module as claimed in claim 1, wherein the at least one alignment device in the carrier includes a plurality of alignment device which are recesses.

3. The collimator module as claimed in claim 1, wherein the carrier includes at least one support device to position the collimator module in a beam incidence direction, the at least one support device interacting with at least one respective abutment device in the detector mechanism of the radiation detector when integrated into the radiation detector.

4. The collimator module as claimed in claim 3, wherein the at least one support device includes a plurality of support devices which are edges of the carrier.

5. The collimator module as claimed in claim 1, wherein the carrier is formed from two carrier elements extending in the collimation direction, and wherein the absorber elements are connected to the carrier elements in a cross-shaped fashion.

6. The collimator module as claimed in claim 5, wherein at least one of the carrier elements and the absorber elements include a plate-like design.

7. The collimator module as claimed in claim 6, wherein cross-shaped connections between the absorber elements and the carrier elements are plug-in connections.

8. The collimator module as claimed in claim 7, wherein the plug-in connections are formed by recesses or slits in at least one of the absorber elements and the carrier elements.

9. The collimator module as claimed in claim 7, wherein the slits in the absorber elements interlock with the corresponding slits in the carrier elements in a cross-shaped fashion.

10. The collimator module as claimed in claim 7, wherein the absorber elements are additionally adhesively bonded to the carrier elements at the cross-shaped connection points.

11. The collimator module as claimed in claim 1, wherein the collimator module includes at least one cover element in at least one of a beam incidence direction and a beam emergence direction, in which cover element the longitudinal edges of the absorber elements are guided at least in part.

12. The collimator module as claimed in claim 1, wherein the carrier elements include at least one fixing device, by which the collimator module is fixable to the detector mechanism.

13. A radiation detector, comprising:

a detector mechanism to hold a collimator; and a radiation convertor aligned with respect to the detector mechanism, wherein the collimator is assembled from collimator modules as claimed in claim 1, and wherein the at least one alignment device of the collimator modules engages in a corresponding at least one positioning device in the detector mechanism for precisely positioning the collimator modules relative to the detector mechanism.

14. The radiation detector as claimed in claim 13, wherein the radiation convertor is subdivided into radiation convertor modules, and wherein each respective collimator module covers two, three, four or five radiation convertor modules.

15. The collimator module as claimed in claim 2, wherein the carrier includes at least one support device to position the collimator module in a beam incidence direction, the at least one support device interacting with at least one respective abutment device in the detector mechanism of the radiation detector when integrated into the radiation detector.

16. The collimator module as claimed in claim 5, wherein cross-shaped connections between the absorber elements and the carrier elements are plug-in connections.

17. A radiation detector, comprising:

a detector mechanism to hold a collimator; and a radiation convertor aligned with respect to the detector mechanism, wherein the collimator is assembled from collimator modules as claimed in claim 2, and wherein the at least one alignment device of the collimator modules engages in a corresponding at least one positioning device in the detector mechanism for precisely positioning the collimator modules relative to the detector mechanism.

18. The radiation detector as claimed in claim 17, wherein the radiation convertor is subdivided into radiation convertor modules, and wherein each respective collimator module covers two, three, four or five radiation convertor modules.

* * * * *